US006036307A

United States Patent [19]

Hakamada et al.

[11] Patent Number: 6,036,307

[45] Date of Patent: Mar. 14, 2000

[54] INK-JET PRINTING PROCESS AND PRINT

[75] Inventors: Shinichi Hakamada, Kawasaki; Masahiro Haruta, Tokyo; Shoji Koike, Yokohama; Koromo Shirota, Kawasaki; Tomoya Yamamoto, Nara; Mariko Suzuki, Yokohama, all of Japan

[73] Assignee: Canon Kabushiki Kaisha, Tokyo, Japan

[21] Appl. No.: 08/842,032

[22] Filed: Apr. 23, 1997

[30] Foreign Application Priority Data

May 2, 1996 [JP] Japan ..... 8-134158
Feb. 27, 1997 [JP] Japan ..... 9-058643

[51] Int. Cl.[7] ..... B41J 3/407

[52] U.S. Cl. ..... 347/106; 347/100

[58] Field of Search ..... 347/106, 100

[56] References Cited

U.S. PATENT DOCUMENTS

| | | | |
|---|---|---|---|
| 4,597,794 | 7/1986 | Ohta et al. | 106/20 |
| 4,689,078 | 8/1987 | Koike et la. | 106/22 |
| 4,702,742 | 10/1987 | Iwata et al. | 8/495 |
| 4,725,849 | 2/1988 | Koike et al. . | |
| 4,849,770 | 7/1989 | Koike et al. . | |
| 4,860,026 | 8/1989 | Matsumoto et al. | 347/15 |
| 4,969,951 | 11/1990 | Koike et al. | 106/22 |
| 5,250,121 | 10/1993 | Yamamoto et al. | 106/22 R |
| 5,358,558 | 10/1994 | Yamamoto et al. | 106/22 R |
| 5,396,275 | 3/1995 | Koike et al. | 347/101 |
| 5,468,553 | 11/1995 | Koike et al. | 428/224 |
| 5,494,733 | 2/1996 | Koike et al. | 428/224 |
| 5,500,023 | 3/1996 | Koike et al. | 8/499 |
| 5,515,093 | 5/1996 | Haruta et al. | 347/101 |
| 5,540,764 | 7/1996 | Haruta et al. | 106/20 R |
| 5,584,918 | 12/1996 | Suzuki et al. | 106/22 R |
| 5,594,485 | 1/1997 | Koike et al. | 347/101 |
| 5,603,756 | 2/1997 | Suzuki et al. | 106/22 R |
| 5,631,684 | 5/1997 | Takaide et al. | 347/100 |
| 5,635,970 | 6/1997 | Shirota et al. | 347/106 |

FOREIGN PATENT DOCUMENTS

| | | |
|---|---|---|
| 640479A1 | 3/1995 | European Pat. Off. . |
| 709519A1 | 5/1996 | European Pat. Off. . |
| 54-59936 | 5/1979 | Japan . |
| 61-118477 | 6/1986 | Japan . |
| 621367A1 | 10/1994 | Japan . |
| 6-305131 | 11/1994 | Japan . |
| 8-218019 | 8/1996 | Japan . |
| 8-218020 | 8/1996 | Japan . |

*Primary Examiner*—N. Le
*Assistant Examiner*—Shih-Wen Hsieh
*Attorney, Agent, or Firm*—Fitzpatrick, Cella, Harper & Scinto

[57] ABSTRACT

Disclosed herein is an ink-jet printing process comprising the three steps of (a) applying inks containing a disperse dye, a compound for dispersing the disperse dye and an aqueous medium to a cloth comprising fibers dyeable with disperse dyes according to an ink-jet system (b) subjecting the cloth, to which the inks have been applied, to a heat treatment and (c) cleaning the heat-treated cloth, wherein the inks comprise two or more inks which separately contain disperse dyes of the same hue and are different in dye concentration, and the thermal diffusivity of the disperse dye used in the ink having a low dye concentration is higher than that of the disperse dye used in the ink having a high dye concentration.

12 Claims, 3 Drawing Sheets

INK-JET PRINTING PROCESS AND PRINT

BACKGROUND OF THE INVENTION

1. Field of the Invention

The present invention relates to an ink-jet printing process wherein printing is conducted on a cloth by ink-jet system to provide a print having excellent gradation and high saturation, and to a printed article obtained by such a process.

2. Related Background Art

At present, textile printing is principally conducted by screen printing or roller printing. Both methods are however unfit for multi-kind small-quantity production and difficult to quickly cope with the fashion of the day. Therefore, there has recently been a demand for establishment of an electronic printing system making no use of any plate.

In compliance with this demand, a great number of textile printing processes according to an ink-jet system have been proposed. Various fields expect much from such textile printing processes.

Requirements of the textile printing processes according to an ink-jet system include:

(1) being able to achieve sufficient color depth upon coloring of ink;

(2) being able to provide a print high in color yield of coloring matter on cloth and to conduct a waste water treatment after a cleaning step with ease;

(3) causing little irregular bleeding due to color mixing between inks of different colors on cloth;

(4) being able to provide prints with wide color reproductivity; and (5) being able to always conduct stable production of prints;

(6) being able to provide images which does not conspicuously give a feeling of grain; and (7) being able to provide images inconspicuous in color unevenness (skitteriness of image) when mixing different colors.

In order to satisfy these requirements, there have been made, for the requirements (1) to (5), such various proposals that various solvents are added to inks, shot-in ink quantity on cloth is controlled, and cloth is subjected to a pretreatment. As an ink-jet printing method for a polyester fabric, it is also disclosed in Japanese Patent Application Laid-Open No. 61-118477 to use disperse dyes having a sublimation temperature of 180° C. or higher.

Further, with respect to the requirement (6), it is disclosed in Japanese Patent Application Laid-Open No. 6-305131 to use two kinds of inks different in dye concentration to prevent graininess. The use of the inks simply different in dye concentration can reduce the graininess from a deep-colored portion to a medium- or pale-colored portion. However, individual dots become conspicuous at portions low in shot-in dot density per unit area like an area ranging from a pale-colored portion to an extremely-pale-colored portion. Further, skitteriness of image occurs when mixed with inks different in color. Therefore, such a method cannot achieve sufficient effect to reduce graininess or skitteriness of image.

SUMMARY OF THE INVENTION

It is therefore an object of the present invention to provide an ink-jet printing process which can satisfy such requirements for the usual ink-jet printing as described above, particularly, the feeling of grain to image of the requirement (6) and the skitteriness of image of the requirement (7), when conducting ink-jet printing on a cloth composed mainly of fibers dyeable with disperse dyes, thereby providing a bright pictorial pattern having excellent gradation, and to a printed article obtained by such a process.

The above object can be achieved by the present invention described below.

According to the present invention, there is thus provided an ink-jet printing process comprising the three steps of:

(a) applying inks containing a disperse dye, a compound for dispersing the disperse dye and an aqueous medium to a cloth comprising fibers dyeable with disperse dyes according to an ink-jet system;

(b) subjecting the cloth, to which the inks have been applied, to a heat treatment; and (c) washing the heat-treated cloth, wherein the inks comprise two or more inks which separately contain disperse dyes of the same hue and different in dye concentration, and the thermal diffusivity of the disperse dye used in the ink having a low dye concentration is higher than that of the disperse dye used in the ink having a high dye concentration.

According to the present invention, there is also provided a printed article obtained in accordance with the ink-jet printing process described above.

DESCRIPTION OF THE PREFERRED EMBODIMENTS

Figure 1:
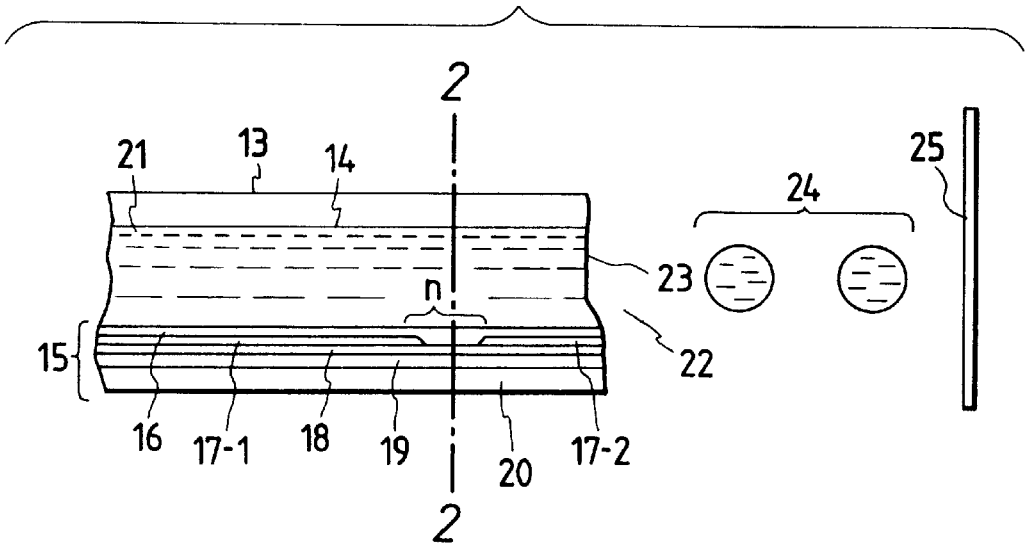
FIG. 1 is a longitudinal cross-sectional view of a head of an ink-jet printing apparatus.

The present invention will hereinafter be described in detail by preferred embodiments of the invention.

The term "same hue" as used in the present invention means a color classified in the same hue when the color after dyed with an ink is compared with the standard color chart (Munsell color chart) in accordance with JIS Z 8721. The standard color chart in accordance with JIS Z 8721 is used for judging a color of the intended object by color samples and classifies hues into 10 colors of R, YR, Y, GY, G, BG, B, PB, P and PR.

The present invention a feature that a dye of a high thermal diffusivity is used in the pale-colored ink, while a dye of a lower thermal diffusivity than the dye used in the pale-colored ink is used in the deep-colored ink.

The ink having a low dye concentration (pale-colored ink) used in the present invention is an ink containing, preferably, a dye selected from among dyes having a color fastness of from Class 2 to Class 3 based on either the gray scale for assessing change in color or the gray scale for assessing staining of polyester, more preferably, a dye selected from among dyes having a color fastness of from Class 2 to Class 3 based on the gray scale for assessing change in color, while the ink having a high dye concentration (deep-colored ink) is an ink containing, preferably, a dye selected from among dyes having a color fastness higher than Class 3 based on both gray scale for assessing change in color and gray scale for assessing staining of polyester, more preferably, a dye selected from among dyes having a color fastness not lower than Class 4.

The term "color fastness" as used in the present invention means a color fastness as determined in accordance with "Method B in Testing Method for Color Fastness to Dry Heating" prescribed in JIS L 0879-1975 (180±2° C., 30 seconds).

The reason why such dyes are selected is as follows:

In general, when gradation printing of the same hue is conducted with deep- and pale-color inks of the same hue, a deep-colored portion is mainly formed by the deep-color ink because sharp edge is required thereof. Since a shot-in ink quantity is also great, the deep-colored portion does not very conspicuously give a feeling of grain. On the other hand, since a pale-colored portion is mainly formed by the pale-color ink, and a shot-in ink quantity is also small, the pale-colored portion conspicuously gives a feeling of grain, and skitteriness of image becomes conspicuous.

On one hand, a dye having a low color fastness, i.e., a dye having high heat diffusivity, generally has a low molecular weight and is weak in interaction between molecules when heated. Therefore, diffusivity of the dye becomes high on cloth, and dots spread upon coloring, so that the resulting image tends to reduce graininess. On the other hand, a dye having a high color fastness, i.e., a dye having low heat diffusivity, contrariwise has a high molecular weight and tends to form dots having sharp edge upon coloring. Therefore, it is considered that when a dye having a low sublimation fastness is used in the ink having a low dye concentration, and a dye having a high sublimation fastness is used in the ink having a high dye concentration, the graininess of the resulting print can be reduced, and the skitteriness of image of the print can be made inconspicuous, thereby providing a bright pictorial pattern having excellent gradation, wherein the edge of the image is sharp at a deep-colored portion, and graininess and skitteriness of image are reduced at a pale-colored portion.

When a dye having a color fastness lower than Class 2 is used in the ink having a low dye concentration, and a cloth printed is subjected to a dyeing treatment by a high-temperature (HT) steaming process or a thermosol process, the color depth and color tone of the resulting print may be deteriorated in some cases. Any dye having a color fastness of from Class 2 to Class 3 has heretofore been said to be unsuitable for the HT steaming process and thermosol process. In the present invention, however, the above dye is used by incorporating it into the ink having a low dye concentration, so that the graininess of the image can be prevented by making good use of spreading of dot, and moreover the skitteriness of image can be prevented though the color depth may be somewhat lowered by the HT steaming process.

No particular limitation is imposed on dyes used in the present invention. However, preferable examples, from the viewpoints of coloring property and ejection property, of the dye used in the ink having a high dye concentration and having a color fastness higher than Class 3 based on both gray scale for assessing change in color and gray scale for assessing staining of polyester include C.I. Disperse Yellow 5, 42, 79, 82, 99, 100, 119, 122, 126, 160, 163, 184:1, 186, 192, 199, 204, 224 and 237; C.I. Disperse orange 13, 29, 30, 31:1, 33, 49, 54, 55, 56, 66, 73, 118, 119 and 163; C.I. Disperse Red 54, 72, 73, 86, 88, 91, 92, 93, 111, 126, 127, 134, 135, 143, 145, 152, 153, 154, 159, 164, 167:1, 177, 181, 204, 206, 207, 221, 239, 240, 258, 277, 278, 283, 288, 311, 323, 343, 348, 356 and 362; C.I. Disperse Violet 26, 33, 46, 57 and 77; C.I. Disperse Blue 60, 73, 87, 113, 128, 143, 148, 154, 158, 165, 165:1, 165:2, 176, 183, 185, 197, 198, 201, 214, 224, 225, 257, 266, 267, 287, 354, 358, 365 and 368; and C.I. Disperse Green 6:1 and 9.

Besides, preferable examples of the dye used in the ink having a low dye concentration and having a color fastness of from Class 2 to Class 3 based on either the gray scale for assessing change in color or the gray scale for assessing staining of polyester include C.I. Disperse yellow 7, 54, 64, 70, 71, 100 and 242; C.I. Disperse Orange 25, 37 and 119; C.I. Disperse Red 50, 60, 65, 146 and 239; C.I. Disperse Violet 27; C.I. Disperse Blue 26, 35, 55, 56, 81:1, 91 and 366.

The content of the dye having a color fastness higher than Class 3 in the ink is within a range of preferably from 1 to 25% by weight, more preferably from 1.5 to 20% by weight based on the total weight of the ink. If the content of the disperse dye is lower than 1% by weight, the color density on the resulting printed cloth may become insufficient in some cases. If the content of the dye exceeds 25% by weight on the other hand, the resulting ink may be deteriorated in storage stability or cause ejection failure due to thickening or deposition attendant on evaporation of the ink in the vicinity of an orifice in some cases.

The content of the dye having a color fastness of from Class 2 to Class 3 in the ink is within a range of from one third down to one tenth, preferably from one fourth down to one eighth by weight of the content of the dye having a color fastness higher than Class 3. If the content of the dye having a color fastness of from Class 2 to Class 3 exceeds one third of the content of the dye having a color fastness higher than Class 3, the effect of reducing graininess of cloth printed may become insufficient in some cases, resulting in a failure to provide a bright pictorial pattern. If the content is lower than one tenth on the other hand, the effect of reducing graininess of cloth printed may also become insufficient at a medium-colored portion in some cases though no problem of graininess arises at a deep-colored portion and an extremely-pale-colored portion.

The inks used in the present invention comprise one of the above-described dyes, a compound for dispersing such a dye and an aqueous medium. As the compound for dispersing the dye, may be used the so-called dispersing agent, surfactant, resinous dispersing agent or the like. As the dispersing agent or surfactant, may be used, for example, both anionic and nonionic types. Examples of the anionic type include fatty acid salts, alkylsulfates, alkylbenzene sulfonates, alkylnaphthalene sulfonates, dialkylsulfosuccinates, salts of alkyl phosphates, naphthalenesulfonic acid-formalin condensates, polyoxyethylene alkylsulfates and substituted derivatives thereof. Examples of the nonionic type include polyoxyethylene alkyl ethers, polyoxyethylene alkyl phenyl ethers, polyoxyethylene fatty acid esters, sorbitan fatty acid esters, polyoxyethylene sorbitan fatty acid esters, polyoxyethylene alkylamines, glycerol fatty acid esters, oxyethylene-oxypropylene block copolymers and substituted derivatives thereof.

Examples of the resinous dispersing agent include block copolymers, random copolymers and graft copolymers composed of at least two monomers (preferably, at least one of which is a hydrophilic monomer) selected from styrene and derivatives thereof, vinylnaphthalene and derivatives thereof, aliphatic alcohol esters of α,β-ethylenically unsaturated carboxylic acids, acrylic acid and derivatives thereof, maleic acid and derivatives thereof, itaconic acid and derivatives thereof, fumaric acid and derivatives thereof, vinyl acetate, vinyl alcohol, vinylpyrrolidone, acrylamide, and derivatives thereof, and salts of these copolymers. These resinous dispersing agents may preferably be alkali-soluble resins which are soluble in an aqueous solution of a base.

The inks used in the present invention comprise an aqueous medium. Water which is a component of the inks may be contained within a range of preferably from 10 to 93% by weight, more preferably from 25 to 87% by weight, most preferably from 30 to 82% by weight based on the total weight of each ink.

The aqueous medium preferably comprises at least one organic solvent in combination with water. Examples of the organic solvent include ketones and keto-alcohols such as acetone and diacetone alcohol; ethers such as tetrahydrofuran and dioxane; addition polymers of oxyethylene or oxypropylene, such as diethylene glycol, triethylene glycol, tetraethylene glycol, dipropylene glycol, tripropylene glycol, polyethylene glycol and polypropylene glycol; alkylene glycols the alkylene moiety of which has 2 to 6 carbon atoms, such as ethylene glycol, propylene glycol, trimethylene glycol, butylene glycol and hexylene glycol; thiodiglycol; glycerol and 1,2,6-hexanetriol; lower alkyl ethers of polyhydric alcohols, such as ethylene glycol monomethyl (or monoethyl) ether, diethylene glycol monomethyl (or monoethyl) ether and triethylene glycol monomethyl (or monoethyl) ether; lower dialkyl ethers of polyhydric alcohols, such as triethylene glycol dimethyl (or diethyl) ether and tetraethylene glycol dimethyl (or diethyl) ether; sulfolane; N-methyl-2-pyrrolidone; 1,3-dimethyl-2-imidazolidinone; and the like.

The above-described organic solvents may be used either singly or in any combination thereof if used in combination with water. However, the most preferable composition of the aqueous medium is such that at least one polyhydric alcohol is contained. Among others, a single solvent of thiodiglycol or diethylene glycol, or a mixed solvent system of diethylene glycol and thiodiglycol is particularly preferred. The content of the organic solvents is generally within a range of from 5 to 60% by weight, preferably from 5 to 50% by weight based on the total weight of the ink.

The principal components of the inks used in the present invention are as described above. However, various kinds of known additives such as viscosity modifiers, surface tension modifiers, optical whitening agents and antifoaming agents may be added as needed. Specific examples thereof include viscosity modifiers such as polyvinyl alcohol, cellulosics and water-soluble resins; surface tension modifiers such as diethanolamine and triethanolamine; pH adjusters according to buffer solutions; and mildewproofing agents.

In addition, various kinds of dispersing agents, surfactants and/or the like may be optionally added as an ingredient for the inks for purposes other than the dispersion of the dye.

Each of the inks used in the present invention can be prepared from the dye, the compound for dispersing the dye, the aqueous medium and optionally other additives using the conventionally-known dispersing method or mixing method, or the like.

A material making up a cloth used in the present invention comprises fibers dyeable with disperse dyes. Among others, those comprising polyester, acetate and/or triacetate are preferred. Of these, those comprising polyester are particularly preferred. The cloth may be used in any form of woven fabric, knit fabric, nonwoven fabric and the like.

Such a cloth preferably comprises 100% of fibers dyeable with disperse dyes. However, blended yarn fabrics or nonwoven fabrics of the fibers dyeable with disperse dyes and other materials, for example, rayon, cotton, polyurethane, acrylic, nylon, wool and silk may be used as cloths useful in the practice of the present invention so far as the blending ratio of the fibers dyeable with the disperse dyes is at least 30%, preferably at least 50%.

The cloth used in the present invention as described above may be subjected to any conventionally-known pretreatment as needed. In particular, it is preferable to contain at least one of urea, a water-soluble polymer, a water-soluble metal salt and the like in an amount of 0.01 to 20% by weight in the cloth.

Examples of the water-soluble polymer include known natural water-soluble polymers, for example, starches from corn, wheat and the like; cellulosics such as carboxymethyl cellulose, methyl cellulose and hydroxyethyl cellulose; polysaccharides such as sodium alginate, gum arabic, locust bean gum, tragacanth gum, guar gum and tamarind seed; proteins such as gelatin and casein; tannin and derivatives thereof; and lignin and derivatives thereof.

Examples of synthetic water-soluble polymers include known polymers such as polyvinyl alcohol type compounds, polyethylene oxide type compounds, water-soluble acrylic polymers and water-soluble maleic anhydride polymers. Of these, the polysaccharide polymers and cellulosic polymers are preferred.

Examples of the water-soluble metal salt include compounds such as halides of alkali metals and alkaline earth metals, which form typical ionic crystals and an aqueous solution of which has a pH of 4 to 10. Representative examples of such compounds include NaCl, $Na_2SO_4$, KCl and $CH_3COONa$ for alkali metals, and $CaCl_2$ and $MgCl_2$ for alkaline earth metals. Of these, salts of Na, K and Ca are preferred.

As an ink-jet system used for the ink-jet printing process according to the present invention, may be used any conventionally-known ink-jet system. However, the method described in, for example, Japanese Patent Application Laid-Open No. 54-59936, in which thermal energy is applied to an ink so as to undergo rapid volume change, and the ink is ejected from a nozzle by action force caused by this change of state, i.e., a bubble jet system, is most effective.

The reason for this is believed to be that if a printing head equipped with a plurality of nozzles is used, the above system is narrow in scattering of ejection velocities of the ink among individual nozzles, and the ejection velocities are summarized within a range of from 5 to 20 m/sec, and so the degree of penetration of ink droplets into a cloth at the time the ink containing a disperse dye impacts the cloth at this velocity becomes optimum.

By using the ink-jet system as a printing method in the present invention, neither deposition of foreign matters on a heating head of the printing apparatus nor disconnection is caused even if printing is conducted continuously for a long period of time. Therefore, the printing can be conducted stably.

As conditions under which a particularly high effect can be achieved by such an ink-jet system, it is preferred that an ejected ink droplet be within a range of from 20 to 200 pl, a shot-in ink quantity be within a range of from 4 to 40 nl/mm$^2$, a drive frequency be at least 1.5 kHz, a head temperature be within a range of from 35 to 60° C. and an ejection velocity be within a range of from 5 to 20 m/sec.

The inks applied to the cloth in the above-described manner only adheres to the cloth in this state. Accordingly, the cloth must be subsequently subjected to a dyeing treatment in which the dye in each ink is fixed to the fibers, and a treatment for removing undyed dyes. Such dyeing and removal of the undyed dyes may be conducted in accordance with the conventionally known methods.

Among others, a high-temperature steaming process (HT steaming process) may preferably be used as the dyeing method. In the case of the HT steaming process, the treatment may preferably be conducted under conditions of 140 to 180° C. and 2 to 30 minutes, more preferably under conditions of 160 to 180° C. and 6 to 8 minutes.

Inks of other hues are further used in combination with the above inks, whereby a full-color image can be obtained.

Incidentally, the thus-obtained print can be cut into desired sizes as needed, and the cut pieces can then be subjected to processes required to obtain final processed articles, such as sewing, bonding and/or welding, thereby obtaining the processed articles such as neckties or handkerchiefs.

As an illustrative example of an apparatus, which is suitable for use in performing the ink-jet printing process according to the present invention, may be mentioned an apparatus in which thermal energy corresponding to printing signals is applied to an ink within a recording head, and ink droplets are generated by the thermal energy. Such an apparatus will hereinafter be described.

Figure 2:
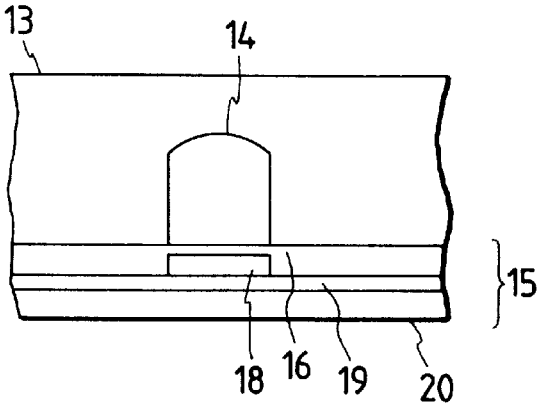
FIG. 2 is a transverse cross-sectional view of the head of the ink-jet printing apparatus.
Figure 3:
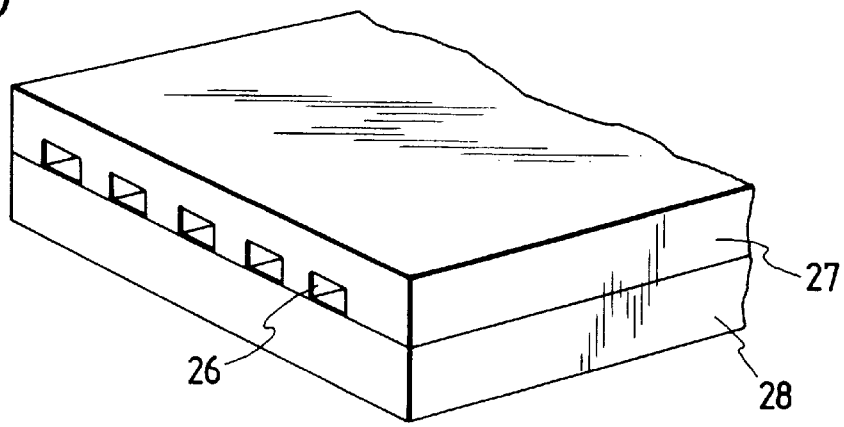
FIG. 3 is a perspective view of the appearance of a multi-head which is an array of such heads as shown in FIG. 1.

Examples of the construction of an head, which is a main component of such an apparatus, are illustrated in FIGS. 1, 2 and 3.

A head 13 is formed by bonding a glass, ceramic, plastic plate or the like having a groove 14 through which ink is passed, to a heating head 15 used in thermal recording (the drawings show a thin-film head to which, however, the invention is not limited). The heating head 15 is composed of a protective film 16 formed of silicon oxide or heating realuminum electrodes 17-1 and 17-2, a heating resistor layer 18 formed of nichrome or the like, a heat accumulating layer 19, and a substrate 20 made of alumina or the like having a good heat radiating property.

An ink 21 comes up to an ejection orifice (a minute opening) 22 and forms a meniscus 23 owing to a pressure (not illustrated).

Now, upon application of electric signals to the electrodes 17-1, 17-2, the heating head 15 rapidly generates heat at the region shown by n to form bubbles in the ink 21 which is in contact with this region. The meniscus 23 of the ink is projected by the action of the pressure thus produced, and the ink 21 is ejected from the ejection orifice 22 to a printing medium 25 in the form of ink droplets 24.

FIG. 3 illustrates an appearance of a multi-head composed of an array of a number of heads as shown in FIG. 1. The multi-head is formed by closely bonding a glass plate 27 having a number of grooves 26 to a heating head 28 similar to the heating head illustrated in FIG. 1.

Incidentally, FIG. 1 is a cross-sectional view of a head taken along a flow path of the ink, and FIG. 2 is a cross-sectional view taken along line 2—2 in FIG. 1.

Figure 4:
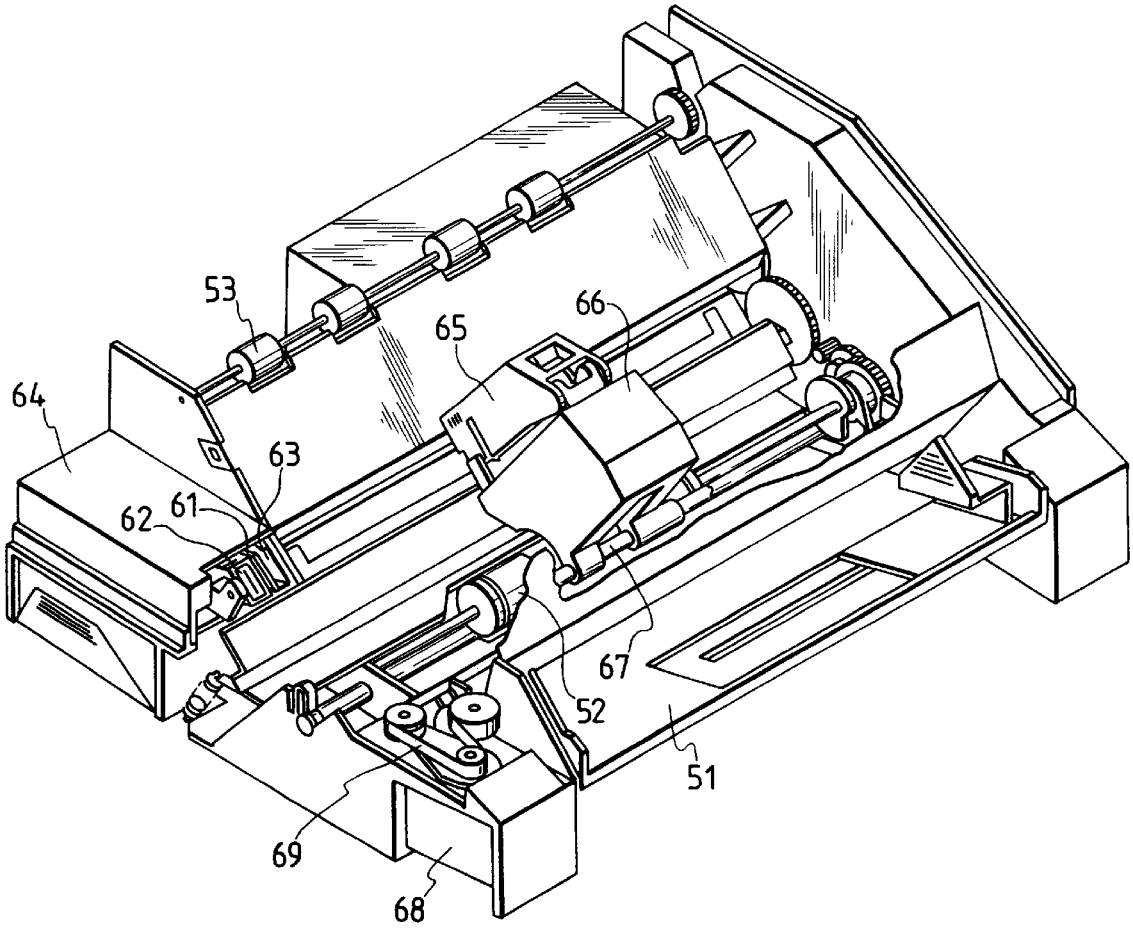
FIG. 4 is a perspective view of an illustrative ink-jet printing apparatus.

FIG. 4 illustrates an example of an ink-jet printing apparatus in which the above head has been incorporated.

In FIG. 4, reference numeral 61 designates a blade serving as a wiping member, one end of which is a stationary end held by a blade-holding member to form a cantilever. The blade 61 is provided at the position adjacent to the region in which a printing head 65 operates, and in this embodiment, is held in such a form that it protrudes into the course through which the printing head 65 is moved.

Reference numeral 62 indicates a cap, which is provided at the home position adjacent to the blade 61, and is so constituted that it moves in the direction perpendicular to the direction in which the printing head 65 is moved and comes into contact with the face of ejection openings to cap it. Reference numeral 63 denotes an absorbing member provided adjoiningly to the blade 61 and, similar to the blade 61, held in such a form that it protrudes into the course through which the printing head 65 is moved.

The above-described blade 61, cap 62 and absorbing member 63 constitute an ejection-recovery portion 64, where the blade 61 and absorbing member 63 remove off water, dust and/or the like from the face of the ink-ejecting openings.

Reference numeral 65 designates the printing head having an ejection-energy-generating means and serving to eject the ink onto the printing medium set in an opposing relation to the ejection opening face provided with ejection openings to conduct printing. Reference numeral 66 indicates a carriage on which the printing head 65 is mounted so that the printing head 65 can be moved.

The carriage 66 is slidably interlocked with a guide rod 67 and is connected (not illustrated) at its part to a belt 69 driven by a motor 68. Thus, the carriage 66 can be moved along the guide rod 67 and hence, the printing head 65 can be moved from a printing region to a region adjacent thereto.

Reference numerals 51 and 52 denote a cloth feeding part from which cloths are separately inserted, and cloth feed rollers driven by a motor (not illustrated), respectively. With such a construction, the printing medium is fed to the position opposite to the ejection opening face of the printing head 65, and discharged from a cloth discharge section provided with cloth discharge rollers 53 with the progress of printing.

In the above construction, the cap 62 in the head recovery portion 64 is receded from the path of motion of the printing head 65 when the printing head 65 is returned to its home position, for example, after completion of printing, and the blade 61 remains protruded into the path of motion. As a result, the ejection opening face of the printing head 65 is wiped. When the cap 62 comes into contact with the ejection opening face of the printing head 65 to cap it, the cap 62 is moved so as to protrude into the path of motion of the printing head 65.

When the printing head 65 is moved from its home position to the position at which printing is started, the cap 62 and the blade 61 are at the same positions as the positions for the wiping as described above. As a result, the ejection opening face of the printing head 65 is also wiped at the time of this movement.

The above movement of the printing head 65 to its home position is made not only when the printing is completed or the printing head 65 is recovered for ejection, but also when the printing head 65 is moved between printing regions for the purpose of printing, during which it is moved to the home position adjacent to each printing region at given intervals, where the ejection opening face is wiped in accordance with this movement.

Figure 5:
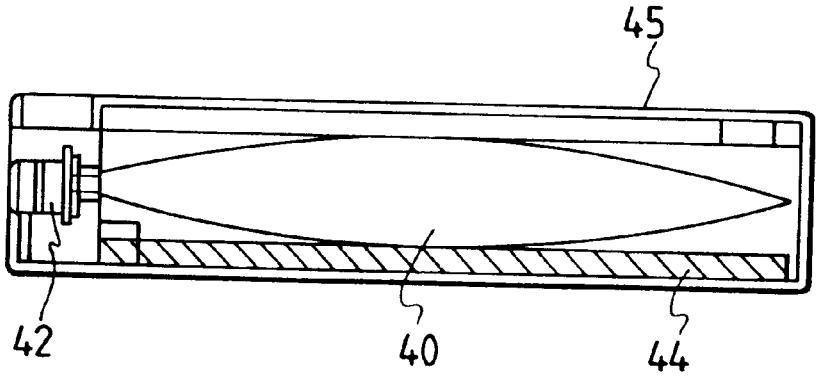
FIG. 5 is a longitudinal cross-sectional view of an ink cartridge.

FIG. 5 illustrates an exemplary ink cartridge 45 in which an ink to be fed to the head through an ink-feeding member, for example, a tube is contained.

Here, reference numeral 40 designates an ink container portion containing the ink to be fed, as exemplified by a bag for the ink. One end thereof is provided with a stopper 42 made of rubber. A needle (not illustrated) may be inserted into this stopper 42 so that the ink in the bag 40 for the ink can be fed to the head. Reference numeral 44 indicates an ink-absorbing member for receiving a waste ink.

In this invention, it is preferable that the ink container portion be formed of a polyolefin, in particular, polyethylene, at its surface with which the ink comes into contact.

The ink-jet printing apparatus used in the present invention are not limited to the apparatus as described above in which the head and the ink cartridge are separately provided. Therefore, a device in which these members are integrally formed as shown in FIG. 6 can also be preferably used.

Figure 6:
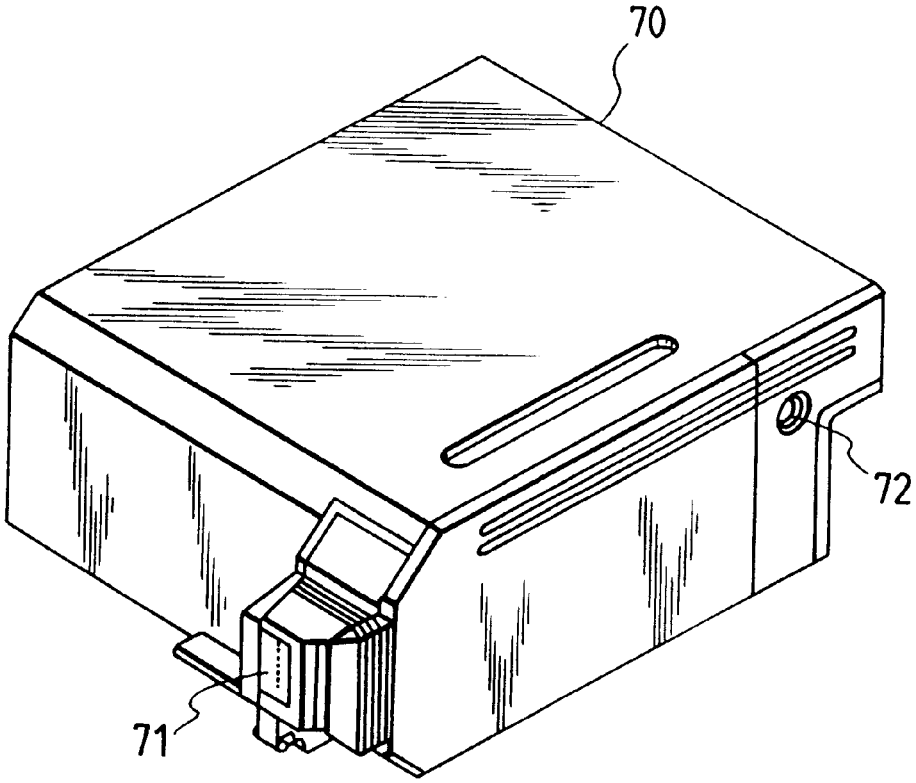
FIG. 6 is a perspective view of a printing unit.

In FIG. 6, reference numeral 70 designates a printing unit, in the interior of which an ink container portion containing an ink, for example, an ink-absorbing member, is contained. The printing unit 70 is so constructed that the ink in such an ink-absorbing member is ejected in the form of ink droplets through a head 71 having a plurality of orifices.

In the present invention, polyurethane is preferably used as a material for the ink-absorbing member. Reference numeral 72 indicates an air passage for communicating the interior of the printing unit 70 with the atmosphere. This printing unit 70 can be used in place of the printing head 65 shown in FIG. 4, and is detachably installed on the carriage 66.

The present invention may be applied to office uses, but is particularly suitable for industrial uses other than the office uses.

The present invention will hereinafter be described more specifically by the following Examples and Comparative Examples. Incidentally, all designations of "part" or "parts" and "%" as will be used in the following examples mean part or parts by weight and % by weight unless expressly noted.

EXAMPLE 1

Preparation of Cloth (A):

A plain weave fabric formed of polyester yarn having an average thickness of 40 deniers composed of polyester filament fibers having an average thickness of 2 deniers was immersed in a 10% aqueous solution of urea in advance, squeezed to a pickup of 60% and then dried, thereby controlling the moisture regain of the plain weave fabric to 7% to provide it as Cloth (A).

Preparation of Dye Dispersions (a) and (b)

| | |
|---|---|
| β-Naphthalenesulfonic acid-formaldehyde condensate | 20 parts |
| Ion-exchanged water | 55 parts |
| Diethylene glycol | 10 parts. |

The above components were mixed into a solution. To each of this solution, were separately added 15 parts of the following disperse dyes to premix the mixtures for 30 minutes. Thereafter, the resulting premixes were subjected to a dispersion treatment under the following conditions:

Disperse dye: C.I. Disperse Blue 165 (for Dye Dispersion (a))

C.I. Disperse Blue 56 (for Dye Dispersion (b))

Dispersing machine: Sand Grinder (manufactured by Igarashi Kikai K.K.)

Grinding medium: zirconium beads (diameter: 1 mm)

Packing rate of the grinding medium: 50% (by volume)

Number of revolutions: 1,500 rpm

Grinding time: 3 hours.

The dispersions were further filtered through a Fluoropore Filter FP-250 (trade name, product of Sumitomo Electric Industries, Ltd.) to remove coarse particles, thereby obtaining Dye Dispersions (a) and (b).

Preparation of Ink (a)

| | |
|---|---|
| Dye Dispersion (a) described above | 40 parts |
| Thiodiglycol | 24 parts |
| Diethylene glycol | 11 parts |
| Ion-exchanged water | 25 parts. |

All the above components were mixed, and the resulting liquid mixture was adjusted to pH 8 with sodium hydroxide, stirred for 2 hours and then filtered through a Fluoropore Filter FP-100 (trade name, product of Sumitomo Electric Industries, Ltd.), thereby preparing Ink (a).

Preparation of Ink (b)

| | |
|---|---|
| Dye Dispersion (b) described above | 7 parts |
| Thiodiglycol | 15 parts |
| Diethylene glycol | 10 parts |
| Tetraethylene glycol dimethyl ether | 5 parts |
| Ion-exchanged water | 63 parts. |

All the above components were mixed, and the resulting liquid mixture was adjusted to pH 8 with sodium hydroxide, stirred for 2 hours and then filtered through a Fluoropore Filter FP-100 (trade name, product of Sumitomo Electric Industries, Ltd.), thereby preparing Ink (b).

Two kinds of the deep-color and pale-color Inks (a) and (b) obtained in the above-described manner were charged in a Color Bubble Jet Printer BJC600 (trade name, manufactured by Canon Inc.) to print a gradation pattern and an image on the Cloth (A). The thus-obtained print sample was then fixed by a steaming treatment at 180° C. for 8 minutes. Thereafter, the sample was washed with water, subjected to reduction cleaning and dried in accordance with a method known per se in the art, thereby obtaining a cloth according to this example, on which a pictorial pattern had been printed. The printed cloth thus obtained was evaluated as to (1) color depth, (2) graininess, (3) definition and (4) tint. The results are shown in Table 1. As apparent from Table 1, it is understood that in Inks (a) and (b) in which dyes of the same hue were separately used, the dye having a high color fastness was used in the ink having a high dye concentration, and the dye having a low color fastness was used in the ink having a low dye concentration, thereby permitting the provision of a bright pattern having high color depth and excellent definition without causing any graininess of the image.

EXAMPLE 2

| Preparation of Dye Dispersions (c) and (d): | |
|---|---|
| Sodium lignin sulfonate | 15 parts |
| Ion-exchanged water | 55 parts |
| Diethylene glycol | 15 parts. |

The above components were mixed into a solution. To each of this solution, were separately added 15 parts of the following disperse dyes to premix the mixtures for 30 minutes. Thereafter, the resulting premixes were subjected to a dispersion treatment under the following conditions:

Disperse dye: C.I. Disperse Red 288 (for Dye Dispersion (c))

C.I. Disperse Red 60 (for Dye Dispersion (d))

Dispersing machine: Sand Grinder (manufactured by Igarashi Kikai K.K.)

Grinding medium: zirconium beads (diameter: 0.5 mm)

Packing rate of the grinding medium: 70% (by volume)

Number of revolutions: 1,500 rpm

Grinding time: 3 hours.

The dispersions were further filtered through a Fluoropore Filter FP-250 (trade name, product of Sumitomo Electric Industries, Ltd.) to remove coarse particles, thereby obtaining Dye Dispersions (c) and (d). Preparation of Ink (c):

| | |
|---|---|
| Dye Dispersion (c) described above | 35 parts |
| Thiodiglycol | 19 parts |
| Diethylene glycol | 11 parts |
| Isopropyl alcohol | 5 parts |
| Ion-exchanged water | 30 parts. |

All the above components were mixed, and the resulting liquid mixture was adjusted to pH 8 with sodium hydroxide, stirred for 2 hours and then filtered through a Fluoropore Filter FP-100 (trade name, product of Sumitomo Electric Industries, Ltd.), thereby preparing Ink (c). Preparation of Ink (d)

| | |
|---|---|
| Dye Dispersion (d) described above | 10 parts |
| Thiodiglycol | 15 parts |
| Diethylene glycol | 10 parts |
| Triethylene glycol | 5 parts |
| Ion-exchanged water | 60 parts. |

All the above components were mixed, and the resulting liquid mixture was adjusted to pH 8 with sodium hydroxide, stirred for 2 hours and then filtered through a Fluoropore Filter FP-100 (trade name, product of Sumitomo Electric Industries, Ltd.), thereby preparing Ink (d).

Two kinds of the deep-color and pale-color Inks (c) and (d) obtained in the above-described manner were charged in a Color Bubble Jet Printer BJC600 (trade name, manufactured by Canon Inc.) to print a gradation pattern and an image on the Cloth (A). The thus-obtained print sample was then fixed by a steaming treatment at 180° C. for 8 minutes. Thereafter, the sample was washed with water, subjected to reduction cleaning and dried in accordance with a method known per se in the art, thereby obtaining a cloth according to this example, on which a pictorial pattern had been printed. The printed cloth thus obtained was evaluated as to (1) color depth, (2) graininess, (3) definition and (4) tint. The results are shown in Table 1. As apparent from Table 1, it is understood that in Inks (c) and (d) in which dyes of the same hue were separately used, the dye having a high color fastness was used in the ink having a high dye concentration, and the dye having a low color fastness was used in the ink having a low dye concentration, thereby permitting the provision of a bright pattern having high color depth and excellent definition without causing any graininess of the image.

EXAMPLE 3

Preparation of Cloth (B)

A plain weave fabric formed of polyester yarn having an average thickness of 70 deniers composed of polyester filament fibers having an average thickness of 0.7 deniers was immersed in a 0.1% aqueous solution of carboxymethyl cellulose in advance, squeezed to a pickup of 60% and then dried, thereby controlling the moisture regain of the plain weave fabric to 10% to provide it as Cloth (B).

Preparation of Dye Dispersions (e) to (h)

| | |
|---|---|
| Sodium polyoxyethylene alkyl ether sulfate | 5 parts |
| β-Naphthalenesulfonic acid-formaldehyde condensate | 10 parts |
| Ion-exchanged water | 55 parts |
| Ethylene glycol | 20 parts. |

The above components were mixed into a solution. To each of this solution, were separately added 10 parts of the following disperse dyes to premix the mixtures for 30 minutes. Thereafter, the resulting premixes were subjected to a dispersion treatment under the following conditions:

Disperse dye: C.I. Disperse Orange 30 (for Dye Dispersion (e))

C.I. Disperse Orange 37 (for Dye Dispersion (f))

C.I. Disperse Yellow 42 (for Dye Dispersion (g))

C.I. Disperse Yellow 54 (for Dye Dispersion (h))

Dispersing machine: Sand Grinder (manufactured by Igarashi Kikai K.K.)

Grinding medium: zirconium beads (diameter: 1 mm)

Packing rate of the grinding medium: 50% (by volume)

Number of revolutions: 1,500 rpm

Grinding time: 3 hours.

The dispersions were further filtered through a Fluoropore Filter FP-250 (trade name, product of Sumitomo Electric Industries, Ltd.) to remove coarse particles, thereby obtaining Dye Dispersions (e) to (h).

Preparation of Ink (e)

| | |
|---|---|
| Dye Dispersion (e) described above | 50 parts |
| Thiodiglycol | 24 parts |
| Diethylene glycol | 11 parts |
| Ion-exchanged water | 15 parts. |

All the above components were mixed, and the resulting liquid mixture was adjusted to pH 8 with sodium hydroxide, stirred for 2 hours and then filtered through a Fluoropore Filter FP-100 (trade name, product of Sumitomo Electric Industries, Ltd.), thereby preparing Ink (e).

Preparation of Ink (f)

| | |
|---|---|
| Dye Dispersion (f) described above | 13 parts |
| Thiodiglycol | 20 parts |
| Diethylene glycol | 10 parts |
| Ion-exchanged water | 57 parts. |

All the above components were mixed, and the resulting liquid mixture was adjusted to pH 8 with sodium hydroxide, stirred for 2 hours and then filtered through a Fluoropore Filter FP-100 (trade name, product of Sumitomo Electric Industries, Ltd.), thereby preparing Ink (f).

Preparation of Ink (g)

| | |
|---|---|
| Dye Dispersion (g) described above | 40 parts |
| Thiodiglycol | 25 parts |
| Diethylene glycol | 8 parts |
| Ion-exchanged water | 27 parts. |

All the above components were mixed, and the resulting liquid mixture was adjusted to pH 8 with sodium hydroxide, stirred for 2 hours and then filtered through a Fluoropore Filter FP-100 (trade name, product of Sumitomo Electric Industries, Ltd.), thereby preparing Ink (g).

Preparation of Ink (h)

| | |
|---|---|
| Dye Dispersion (h) described above | 6 parts |
| Thiodiglycol | 28 parts |
| Diethylene glycol | 15 parts |
| Ion-exchanged water | 51 parts. |

All the above components were mixed, and the resulting liquid mixture was adjusted to pH 8 with sodium hydroxide, stirred for 2 hours and then filtered through a Fluoropore Filter FP-100 (trade name, product of Sumitomo Electric Industries, Ltd.), thereby preparing Ink (h).

Four kinds of the deep-color and pale-color Inks (e), (f), (g) and (h) obtained in the above-described manner were charged in a Color Bubble Jet Printer BJC600 (trade name, manufactured by Canon Inc.) to print a gradation pattern and an image on the Cloth (B). The thus-obtained print sample was then fixed by a steaming treatment at 180° C. for 8 minutes. Thereafter, the sample was washed with water, subjected to reduction cleaning and dried in accordance with a method known per se in the art, thereby obtaining a cloth according to this example, on which a pictorial pattern had been printed. The printed cloth thus obtained was evaluated as to (1) color depth, (2) graininess, (3) definition, (4) tint and (5) skitteriness of image. The results are shown in Table 1.

As apparent from Table 1, it is understood that in Inks (e) and (f), and (g) and (h) in which dyes of the same hue were separately used, the dyes having a high color fastness were used in the inks having a high dye concentration, and the dyes having a low color fastness were used in the inks having a low dye concentration, thereby permitting the provision of a bright pattern having high color depth and excellent definition without causing any graininess of the image. Inks (e) and (f) were of an orange color, while Inks (g) and (h) were of a yellow color. Even when these colors were mixed, a pictorial pattern free of any skitteriness of image was able to be obtained.

Comparative Example 1

Preparation of Dye Dispersions (i) and (j)

| | |
|---|---|
| β-Naphthalenesulfonic acid-formaldehyde condensate | 20 parts |
| Ion-exchanged water | 55 parts |
| Diethylene glycol | 10 parts. |

The above components were mixed into a solution. To each of this solution, were separately added 15 parts of the following disperse dyes to premix the mixtures for 30 minutes. Thereafter, the resulting premixes were subjected to a dispersion treatment under the following conditions:

Disperse dye: C.I. Disperse Blue 354 (for Dye Dispersion (i))

C.I. Disperse Blue 158 (for Dye Dispersion (j))

Dispersing machine: Sand Grinder (manufactured by Igarashi Kikai K.K.)

Grinding medium: zirconium beads (diameter: 1 mm)

Packing rate of the grinding medium: 50% (by volume)

Number of revolutions: 1,500 rpm

Grinding time: 3 hours.

The dispersions were further filtered through a Fluoropore Filter FP-250 (trade name, product of Sumitomo Electric Industries, Ltd.) to remove coarse particles, thereby obtaining Dye Dispersions (i) and (j).

Preparation of Ink (i)

| | |
|---|---|
| Dye Dispersion (i) described above | 40 parts |
| Thiodiglycol | 24 parts |
| Diethylene glycol | 11 parts |
| Ion-exchanged water | 25 parts. |

All the above components were mixed, and the resulting liquid mixture was adjusted to pH 8 with sodium hydroxide, stirred for 2 hours and then filtered through a Fluoropore Filter FP-100 (trade name, product of Sumitomo Electric Industries, Ltd.), thereby preparing Ink (i).

The deep-color Ink (i) obtained in the abovedescribed manner and the pale-color Ink (b) used in Example 1 (wherein the inks were inks prepared by separately using dyes different in hue) were used to print the same pattern as in Example 1 on the same Cloth (A) as that used in Example 1 in the same manner as in Example 1. The thus-obtained print sample was then fixed by a steaming treatment at 180° C. for 8 minutes. Thereafter, the sample was washed with water, subjected to reduction cleaning and dried in accordance with a method known per se in the art, thereby obtaining a cloth according to the comparative example, on which a pictorial pattern had been printed. The printed cloth thus obtained was evaluated as to (1) color depth, (2) graininess, (3) definition and (4) tint. The results are shown in Table 1.

As apparent from Table 1, it is understood that even when the dye having a high color fastness was used in the ink having a high dye concentration, and the dye having a low color fastness was used in the ink having a low dye concentration, the tint of the resulting image was changed due to the use of the dyes different in hue though no problems arose on the color depth, graininess and definition of the image.

Comparative Example 2

Preparation of Ink (j)

| | |
|---|---|
| Dye Dispersion (j) described above | 7 parts |
| Thiodiglycol | 15 parts |
| Diethylene glycol | 10 parts |
| Isopropyl alcohol | 5 parts |
| Ion-exchanged water | 63 parts. |

All the above components were mixed, and the resulting liquid mixture was adjusted to pH 8 with sodium hydroxide, stirred for 2 hours and then filtered through a Fluoropore Filter FP-100 (trade name, product of Sumitomo Electric Industries, Ltd.), thereby preparing Ink (j).

The pale-color Ink (j) obtained in the above-described manner and the deep-color Ink (a) used in Example 1 were used to print the same pattern as in Example 1 on the same Cloth (A) as that used in Example 1 in the same manner as in Example 1. The thus-obtained print sample was then fixed by a steaming treatment at 180° C. for 8 minutes. Thereafter, the sample was washed with water, subjected to reduction cleaning and dried in accordance with a method known per se in the art, thereby obtaining a cloth according to the comparative example, on which a pictorial pattern had been printed. The printed cloth thus obtained was evaluated as to (1) color depth, (2) graininess, (3) definition and (4) tint. The results are shown in Table 1.

As apparent from Table 1, it is understood that since the dyes having a high color fastness were used in both ink having a high dye concentration and ink having a low dye concentration, the printed cloth clearly gave a feeling of grain at a pale-colored portion though no problems arose on the color depth, definition and tint.

Comparative Example 3

Preparation of Ink (k)

| | |
|---|---|
| Dye Dispersion (f) described above | 35 parts |
| Thiodiglycol | 19 parts |
| Diethylene glycol | 11 parts |
| Isopropyl alcohol | 5 parts |
| Ion-exchanged water | 30 parts. |

All the above components were mixed, and the resulting liquid mixture was adjusted to pH 8 with sodium hydroxide, stirred for 2 hours and then filtered through a Fluoropore Filter FP-100 (trade name, product of Sumitomo Electric Industries, Ltd.), thereby preparing Ink (k).

Preparation of Ink (l)

| | |
|---|---|
| Dye Dispersion (c) described above | 10 parts |
| Thiodiglycol | 15 parts |
| Diethylene glycol | 10 parts |
| Triethylene glycol | 5 parts |
| Ion-exchanged water | 60 parts. |

All the above components were mixed, and the resulting liquid mixture was adjusted to pH 8 with sodium hydroxide, stirred for 2 hours and then filtered through a Fluoropore Filter FP-100 (trade name, product of Sumitomo Electric Industries, Ltd.), thereby preparing Ink (l).

Two kinds of the deep-color and pale-color Inks (k) and (l) obtained in the above-described manner (wherein the inks were inks prepared by separately using dyes different in hue) were charged in a Color Bubble Jet Printer BJC600 (trade name, manufactured by Canon Inc.) to print a gradation pattern and an image on the same Cloth (A) as used in Example 1. The thus-obtained print sample was then fixed by a steaming treatment at 180° C. for 8 minutes. Thereafter, the sample was washed with water, subjected to reduction cleaning and dried in accordance with a method known per se in the art, thereby obtaining a cloth according to the comparative example, on which a pictorial pattern had been printed. The printed cloth thus obtained was evaluated as to (1) color depth, (2) graininess, (3) definition and (4) tint. The results are shown in Table 1.

As apparent from Table 1, it is understood that since the dye having a low color fastness was used in the ink having a high dye concentration, and the dye having a high color fastness was used in the ink having a low dye concentration, the image formed was low in color depth and also lacking in definition though the graininess of the image could be prevented, resulting in a failure to provide any bright pictorial pattern. Besides, the tint of the image was changed due to the use of the dyes different in hue.

TABLE 1

| | | Ink | Color fastness | (1) Density on attainment of maximum | (2) Graininess | (3) Definition | (4) Tint | (5) Skitteriness of image |
|---|---|---|---|---|---|---|---|---|
| Ex. 1 | a | Deep | 4–5 | 29.2 | A | A | A | — |
| | b | Pale | 2–3 | | | | | |
| Ex. 2 | c | Deep | 4 | 19.2 | A | A | A | — |
| | d | Pale | 2–3 | | | | | |
| Ex. 3 | e | Deep | 4 | 16.5 | A | A | A | A |
| | f | Pale | 3 | | | | | |
| | g | Deep | 4 | 19.4 | A | A | A | |
| | h | Pale | 2–3 | | | | | |
| Comp. | i | Deep | 3–4 | 13.2 | A | A | C | — |
| Ex. 1 | b | Pale | 2–3 | | | | | |
| Comp. | a | Deep | 4–5 | 30.1 | C | A | A | — |
| Ex. 2 | j | Pale | 4–5 | | | | | |
| Comp. | k | Deep | 2–3 | 10.1 | A | H | C | — |
| Ex. 3 | l | Pale | 4 | | | | | |

(1) Density on attainment of maximum

A print patch of variable-density gradation (the constitution of which is shown in Table 2), which was divided into 21 grades between densities of 0% and 100%, was printed. After the resultant print patch was subjected to a heat treatment and cleaning, its chromaticity L* was measured by a spectrophotometer manufactured by MINOLTA CAMERA CO. LTD. to determine a maximum value of K/S.

$$K/S=(1-R)/2R$$

where R is reflectance at a maximum absorption wavelength.

TABLE 2

| Gradation ratio | 0 | 5 | 10 | 15 | 20 | 25 | 30 | 35 | 40 | 45 | 50 | 55 | 60 | 65 | 70 | 75 | 80 | 85 | 90 | 95 | 100 |
|---|---|---|---|---|---|---|---|---|---|---|---|---|---|---|---|---|---|---|---|---|---|
| Shot-in rate of deep ink, % | 0 | 0 | 0 | 0 | 0 | 0 | 40 | 40 | 50 | 50 | 60 | 60 | 70 | 70 | 80 | 80 | 90 | 90 | 100 | 100 | 100 |
| Shot-in rate of pale ink, % | 0 | 10 | 30 | 50 | 80 | 100 | 50 | 100 | 50 | 100 | 50 | 100 | 50 | 100 | 50 | 100 | 50 | 100 | 0 | 50 | 100 |

(2) Graininess:

A print patch of variable-density gradation, which was divided into 21 grades between densities of 0% and 100%, was printed in the same manner as in the item (1). After the resultant print patch was subjected to a heat treatment and cleaning, it was visually observed as to whether graininess appeared or not, thereby ranking it in accordance with the following standard.

A: No graininess was observed even at an extremely-pale-colored portion;

B: Graininess was observed at an extremely-pale-colored portion; and

C: Graininess was observed even at a pale-colored portion.

(3) Definition

Sharpness of fine lines and edges of an image sample was visually observed to rank the definition of the image in accordance with the following standard.

A: No disorder was observed;

B: Disorder was somewhat observed; and

C: Disorder was observed to a great extent.

(4) Tint

A print patch of variable-density gradation, which was divided into 21 grades between densities of 0% and 100%, was printed in the same manner as in the item (1). After the resultant print patch was subjected to a heat treatment and cleaning, the chromaticities, L*a*b* of patch portions corresponding to 20, 40, 60, 80 and 100% were measured by a spectrophotometer C-M2022 manufactured by MINOLTA CAMERA CO. LTD. to determine whether they were classified in the same hue in the Munsell color chart (JIS Z 8721) or not, thereby ranking the tint of the print sample in accordance with the following standard.

A: All patch portions were classified in the same hue;

B: Four patch portions were classified in the same hue; and

C: At least two patch portions were not classified in the same hue.

(5) Skitteriness of image (in Example 3)

A print patch of variable-density gradation, which was divided into 21 grades between densities of 0% and 100%, was printed in the same manner as in the item (1) except that orange and yellow colors were mixed. After the resultant print patch was subjected to a heat treatment and cleaning, it was observed mainly at its pale-color-mixed portion as to whether skitteriness of image (graininess at a color-mixed portion) appeared or not, thereby ranking it in accordance with the following standard.

A: No skitteriness of image was observed; and

C: Skitteriness of image was observed.

According to the ink-jet printing process of the present invention, as described above, there can be provided prints which do not give a feeling of grain at their pale-colored portions and a feeling of irregularity at their color-mixed portions and have excellent definition.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An ink-jet printing process comprising the three steps of:

(a) applying a first aqueous ink and a second aqueous ink to a cloth comprising fibers, the first aqueous ink containing a first disperse dye and a compound for dispersing the first disperse dye and the second aqueous ink containing a second disperse dye and a compound for dispersing the second disperse dye;

(b) subjecting the cloth, to which the inks have been applied, to a heat treatment; and (c) washing the cloth resulting from step (b), wherein a dye concentration of the first ink is higher than a dye concentration of the second ink, and the first disperse dye and the second disperse dye are different from each other, and both of the disperse dyes are a same hue in the Munsell color chart, and wherein the second dye has a color fastness of from Class 2 to 3 as determined in accordance with Method B in "Testing Method for Color Fastness to Dry Heating" prescribed in JIS L 0879-1975, and the first disperse dye has a color fastness of higher than Class 3.

2. The ink-jet printing process according to claim 1, wherein the dye concentration of the second ink is within a range of from ⅓–1/10 of that of the first ink.

3. The ink-jet printing process according to claim 2, wherein the dye concentration of the second ink is within a range of ¼–⅛ of that of the first ink.

4. The ink-jet printing process according to claim 1, wherein the cloth comprises polyester fibers.

5. The ink-jet printing process according to claim 1, wherein the heat treatment in the step (b) is a high-temperature steaming process.

6. The ink-jet printing process according to claim 1, wherein the ink-jet system is a system that thermal energy is applied to inks to eject the inks.

7. The ink-jet printing process according to claim 1, wherein the ejection velocity of the inks is within a range of from 5 to 20 m/sec.

8. The ink-jet printing process according to claim 1, which comprises a step of pretreating the cloth prior to the step (a).

9. The ink-jet printing process according to claim 8, wherein the pretreatment is conducted with at least one of urea, a water-soluble polymer and a water-soluble metal salt.

10. The ink-jet printing process according to claim 1, further comprising a step of applying a third ink which is different from the first and second inks in its hue.

11. A printed article obtained in accordance with the ink-jet printing process according to any one of claims 1, 2, 3, and 4 to 10.

12. An ink-jet printing process comprising the steps of:

(i) providing a first aqueous ink containing a first disperse dye and a compound for dispersing the first disperse dye and second aqueous inks containing a second disperse dye and a compound for dispersing the second disperse dye, the first disperse dye and the second disperse dye being a same hue in a Munsell color chart, the second disperse dye having a color fastness of from Class 2 to 3 as determined in accordance with Method B in "Testing Method for Color Fastness to Dry Heating" prescribed in JIS L 0879-1975, and the first disperse dye having a color fastness of higher than Class 3, and the first ink having a higher dye-concentration than the second ink;

(ii) applying the first and second aqueous inks to a cloth;

(iii) heating the cloth to which the first and the second inks have been applied, and diffusing the second dye on the cloth so as to alleviate graininess; and (iv) washing the cloth resulting from the step (iii).

* * * * *

UNITED STATES PATENT AND TRADEMARK OFFICE

CERTIFICATE OF CORRECTION

PATENT NO. : 6,036,307

DATED : March 14, 2000

INVENTOR(S) : SHINICHI HAKAMADA, ET AL.

It is certified that error appears in the above-identified patent and that said Letters Patent is hereby corrected as shown below:

COLUMN 14:

Line 27, "abovedescribed" should read --above-described--.

COLUMN 19:

Line 2, "claims 1, 2" should read --claims 1 to 10--.
Line 3, "3, and 4 to 10." should be deleted.

Signed and Sealed this

Tenth Day of April, 2001

*Attest:*

Nicholas P. Godici

NICHOLAS P. GODICI

*Attesting Officer*

*Acting Director of the United States Patent and Trademark Office*